US011008193B2

(12) United States Patent
Rodgers et al.

(10) Patent No.: US 11,008,193 B2
(45) Date of Patent: May 18, 2021

(54) DRIVE SHAFT FOR REUSABLE PAPER CORE

(71) Applicant: First Data Corporation, Coral Springs, FL (US)

(72) Inventors: Bradley Rodgers, Papillion, NE (US); Ron Weedin, Omaha, NE (US)

(73) Assignee: FIRST DATA CORPORATION, Greenwood Village, CO (US)

( * ) Notice: Subject to any disclaimer, the term of this patent is extended or adjusted under 35 U.S.C. 154(b) by 0 days.

(21) Appl. No.: 16/842,365

(22) Filed: Apr. 7, 2020

(65) Prior Publication Data

US 2020/0231405 A1 Jul. 23, 2020

Related U.S. Application Data

(63) Continuation of application No. 15/717,403, filed on Sep. 27, 2017, now Pat. No. 10,647,542.

(51) Int. Cl.

| | |
|---|---|
| ***B65H 75/18*** | (2006.01) |
| ***B41M 3/00*** | (2006.01) |
| ***B65H 75/10*** | (2006.01) |

(52) U.S. Cl.

CPC ..... *B65H 75/185* (2013.01); *B41M 3/00* (2013.01); *B65H 75/10* (2013.01); *B65H 2701/5114* (2013.01); *B65H 2801/21* (2013.01)

(58) Field of Classification Search

CPC .... B65H 7/185; B65H 75/10; B65H 2801/21; B65H 2701/5114; B41M 3/00; B41J 15/02; B41J 15/04

See application file for complete search history.

(56) References Cited

U.S. PATENT DOCUMENTS

| | | | | |
|---|---|---|---|---|
| 1,385,635 | A | 7/1921 | Martin | |
| 1,524,483 | A | 1/1925 | Lowe | |
| 1,555,346 | A | 9/1925 | Zecher | |
| 1,881,911 | A | 10/1932 | Howard | |
| 1,885,789 | A | 11/1932 | Alderfer | |
| 1,990,860 | A | 2/1935 | Ellsworth | |
| 2,113,701 | A | 4/1938 | Mayer | |
| 2,223,682 | A | 12/1940 | Gammeter | |
| 2,558,689 | A * | 6/1951 | Miller | B65H 75/246 242/575.3 |

(Continued)

OTHER PUBLICATIONS

Non-Final Office Action dated Sep. 17, 2019 in related U.S. Appl. No. 15/717,403, all pgs.

(Continued)

*Primary Examiner* — William A. Rivera
(74) *Attorney, Agent, or Firm* — Foley & Lardner LLP

(57) ABSTRACT

A driveshaft for a reusable paper core includes a shaft body having a proximal end, a distal end, and a medial portion extending between the proximal end and the distal end. An outer periphery of the medial portion has a non-circular cross-sectional shape. The driveshaft includes one or more receptacles provided in an outer surface of the medial portion of the shaft body, a first bearing coupled with the distal end, a second bearing coupled with the proximal end, and one or more gear keys coupled with the proximal end. The one or more gear keys may be configured to transfer force from a rotating machine element to the driveshaft.

21 Claims, 10 Drawing Sheets

(56) References Cited

U.S. PATENT DOCUMENTS

| | | | | |
|---|---|---|---|---|
| 2,703,209 | A * | 3/1955 | Crutcher | B65H 19/10 242/559.2 |
| 5,174,840 | A | 12/1992 | Anderson | |
| 5,312,059 | A * | 5/1994 | Membrino | B65H 18/08 242/525 |
| 5,370,337 | A | 12/1994 | Pratt | |
| 5,535,961 | A | 7/1996 | Duckworth | |
| 6,305,638 | B1 | 10/2001 | Rodriguez | |
| 6,390,759 | B1 | 5/2002 | Novak et al. | |
| 6,435,446 | B1 | 8/2002 | Matsuzawa | |
| 6,679,489 | B2 | 1/2004 | Casto et al. | |
| 6,779,319 | B2 | 8/2004 | Smith et al. | |
| 6,802,500 | B2 | 10/2004 | Bennett et al. | |
| 6,860,496 | B2 | 3/2005 | Novak et al. | |
| 7,051,971 | B2 | 5/2006 | Takeda | |
| 7,380,715 | B2 | 6/2008 | Bennett et al. | |
| 10,647,542 | B2 | 5/2020 | Rodgers et al. | |
| 2010/0096797 | A1* | 4/2010 | Chen | B65H 3/0669 271/109 |
| 2011/0048154 | A1* | 3/2011 | Malone | F16D 1/06 74/473.3 |
| 2018/0016109 | A1* | 1/2018 | Yokoyama | G03G 15/6529 |

OTHER PUBLICATIONS

Notice of Allowance dated Jan. 8, 2020 in related U.S. Appl. No. 15/717,403, all pgs.

* cited by examiner

DRIVE SHAFT FOR REUSABLE PAPER CORE

CROSS-REFERENCES TO RELATED APPLICATIONS

This application is a continuation application of U.S. patent application Ser. No. 15/717,404, entitled "Reusable Paper Core," filed Sep. 27, 2017, the complete disclosure of which is herein incorporated by reference.

BACKGROUND OF THE INVENTION

Paper statements and mailing inserts have conventionally been printed using large rolls of paper. Printers and mail insert apparatus used in industrial and commercial applications, such as in paper mills and warehouses, often use a large paper roll having a hollow cylindrical cardboard core as a starting material to print high volumes of letters and forms. These paper rolls are typically over four feet in diameter, and each one can weigh eight hundred pounds or more. These rolls of paper are typically coiled around cardboard cores that are mounted on round air-based drive shafts. For example, these airshafts may have a metal core that is surrounded by an air bladder. Once inserted into an opening in the cardboard paper core, the air bladder may be inflated until the air bladder presses against an inner surface of the cardboard core. These airshafts may be mounted on large printing systems for printing the statements and other inserts. This process takes a significant amount of time, as the airshaft must be inserted into the cardboard core and the airshaft needs to be inflated.

Due to the high weight of the paper any leak in the airshaft and/or gap in the interface between the airshaft and the cardboard core may result in the airshaft slipping within the cardboard core, which leads to uneven winding of the paper about the cardboard core. Additionally, both the airshaft and the cardboard core may wear out over time and necessitate replacement. The costs associated with such replacement are quite high. Moreover, the airshafts and cardboard cores are quite heavy—upwards of 75 pounds, making them difficult to move and mount on the printers or other equipment.

BRIEF SUMMARY OF THE INVENTION

Embodiments of the invention are directed to reusable paper cores for use in large, industrial printing applications, such as the printing of billing statements, mailing inserts, and the like. The reusable paper cores described herein are formed from metal materials, such as aluminum, to ensure the cores may be reused through numerous print cycles while holding up to the weight of the paper itself. The paper cores may be mounted on non-circular drive shafts of the printing devices that may rotate the paper cores and paper rolls during the printing and/or insert processes. These paper cores may eliminate the waste associated with cardboard cores and airshafts, as well as reduce an amount of paper waste associated with retake up for the backend of a printer.

In one aspect, a reusable paper core is provided. The reusable paper core may include a cylindrical body having a circular outer periphery surrounding an open interior. The cylindrical body may be configured to receive a roll of paper. The paper core may also include at least one plate that spans at least a portion of the open interior such that the at least one plate connects at least two portions of the outer periphery. The at least one plate may define a non-circular central opening.

In another aspect, a reusable paper core system is provided. The system may include a cylindrical body having a circular outer periphery surrounding an open interior. The cylindrical body may be configured to receive a roll of paper. The system may also include at least one plate that spans at least a portion of the open interior such that the at least one plate connects at least two portions of the outer periphery. The at least one plate may define a non-circular central opening. The system may further include a drive shaft that is configured to extend through the non-circular central opening of the at least one plate. An outer surface of the drive shaft may have a shape corresponding to the non-circular central opening such that rotation of the drive shaft causes the cylindrical body and the at least one plate to rotate at a same rate as the drive shaft.

In another aspect, a method for printing mailing inserts is provided. The method may include securing one end of a roll of paper to a reusable paper core. The reusable paper core may include a cylindrical body having a circular outer periphery surrounding an open interior. The cylindrical body may be configured to receive a roll of paper. The paper cores may include at least one plate that spans at least a portion of the open interior such that the at least one plate connects at least two portions of the outer periphery. The at least one plate may define a non-circular central opening. The method may also include mounting the reusable paper core on a non-circular drive shaft by inserting the drive shaft within the non-circular central opening of the at least one plate. The method may further include coupling the drive shaft to a motor of a printing mechanism such that the printing mechanism can rotate the reusable paper core by rotating the drive shaft.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION OF THE INVENTION

Figure 1:
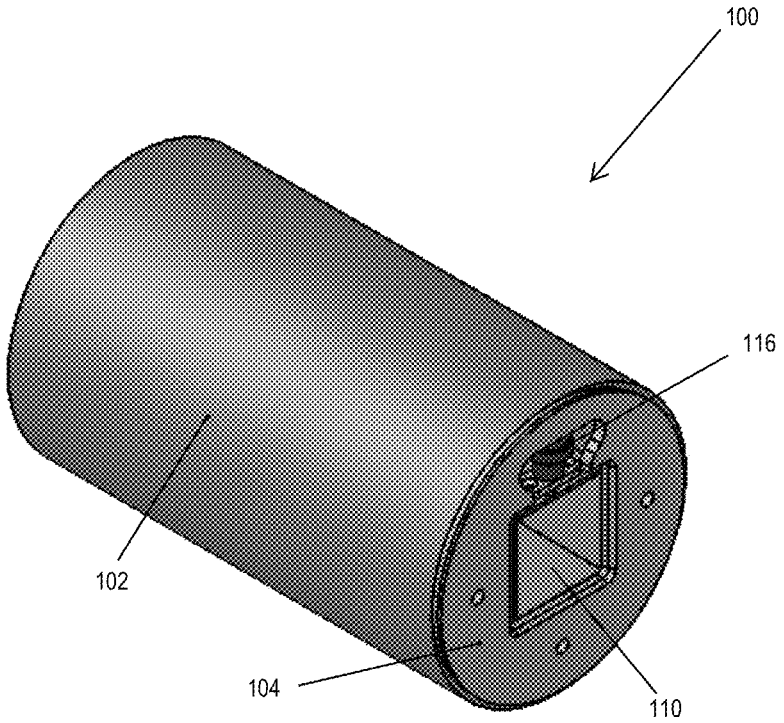
FIG. 1 is an isometric view of a metallic paper core according to embodiments.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the invention are directed to reusable paper cores for use in large, industrial printing and mail insert applications, such as the printing of billing statements, mailing inserts, and the like. While described largely in accordance with paper statements and inserts, it will be appreciated that the paper cores and drive shafts described herein may be utilized in any printing applications that utilize rolls of paper. The reusable paper cores described herein are formed from metal materials, such as aluminum, to ensure the cores may be reused through numerous print cycles while holding up to the weight of the paper itself. The paper cores may be mounted on non-circular drive shafts of the printing devices that may rotate the paper cores and paper rolls and prevent slippage of the drive shafts within the paper core, thereby eliminating the resultant uneven winding of paper onto or off of the core associated with the use of cardboard paper cores and airshafts during the printing and/or insert process. These paper cores may eliminate the waste associated with cardboard cores and airshafts, as well as reduce an amount of paper waste associated with retake up for the backend of a printer. Additionally, the process of mounting may be sped up due to the elimination of certain steps, such as inflating the air bladder of an air drive shaft.

In some embodiments, the paper cores described herein may be used both in a printing mechanism and in a mail insert mechanism. For example, an empty paper core may be mounted on a drive shaft and loaded into a printer. An end of a roll of paper may be secured to an outer surface of the paper core, such as by using tape or another adhesive material. The printer mechanism may then print statements or other information on the paper and rotate the drive shaft and paper core to wind the printed paper onto the paper core. Once printed and rolled up, the paper roll may need to be transported to an insert apparatus. Due to the extreme weight and general fragility of the paper roll, specialized carts may be used to move the paper rolls. Examples of such carts are described in U.S. Pat. Nos. 6,390,759 and 6,860,496, the entire contents of which are hereby incorporated by reference. Once transported to the insert apparatus, the paper roll, paper core, and drive shaft may be mounted. The insert apparatus may then rotate the drive shaft to unroll the paper for cutting and inserting individual statements, inserts, and the like into mailings. Examples of mail insert apparatus may be found, for example, in U.S. Pat. Nos. 6,802,500, 6,779,319, 7,380,715, and 6,679,489, the entire contents of which are hereby incorporated by reference. In many embodiments, the printer and insert mechanisms may use different drive shafts. In such embodiments, a drive shaft that is compatible with each particular machine may be inserted and secured within the paper core prior to mounting the paper core within the machinery. Because the paper cores described herein eliminate the use of airshafts, additional time is saved as the new drive shafts may be quickly inserted and locked within the paper cores using simple mechanical coupling mechanisms, thus eliminating the time needed to inflate and deflate two sets of air bladders for two different airshafts as is necessary in conventional applications.

The presently described paper cores may be hollow and configured to receive a non-circular drive shaft. The use of a hollow metal paper core and a simple metal drive shaft can result in significant weight reduction of the paper cores, which may be as light as 45 pounds or less for use with conventional paper rolls. The diameter of the paper core may be sized to reduce paper waste, such as waste associated with retake up for the back end of a printer. Additionally, by eliminating the use of cardboard and air bladders and replacing them with an all-metallic core and drive shaft assembly, more durable paper mounting solutions are provided that can significantly reduce replacement costs associated with conventional cardboard paper cores and airshafts.

Turning now to FIG. 1, an embodiment of a metal paper core 100 is shown. Paper core 100 may be formed from a hollow cylindrical body 102. Cylindrical body 102 may be formed from a metal material, such as aluminum, that can provide enough strength to support large rolls of paper while still being light enough for easy transport and attachment to print and/or insert mechanisms. An outer surface of the cylindrical body 102 may form a spool around which the paper may be wrapped. For example, one end of the paper may be secured to the outer surface, such as by taping and/or otherwise adhering the paper to the outer surface. The paper may then be rolled around the cylindrical body 102 to form a large roll of paper having a diameter that may exceed 50 inches. In some embodiments, the cylindrical body 102 may have a diameter of between about 2-4 inches, more commonly between about 2.5-3.5 inches, although the diameter may be dependent on the amount of paper to be supported. Cylindrical body 102 is often between about 12 and 18 inches long, and more commonly between about 14-16 inches long. The length may be determined based on a size of paper to be rolled, with shorter or longer lengths possible.

Paper core 100 may also include one or more plates 104 that are coupled with the cylindrical body 102. For example, a plate 104 may be coupled at each end of the cylindrical body 102. In other embodiments, one or more plates 104 may be positioned within the cylindrical body 102 at one or more positions within the interior of the cylindrical body 102. It will be appreciated that any combination of positions and numbers of plates 104 may be utilized in accordance with the present invention. Each plate 104 may define at least one non-circular central opening 106. The non-circular opening 106 may be configured to receive a non-circular drive shaft that is used to rotate the paper core 100 when mounted to a print mechanism. While shown here as being square-shaped, it will be appreciated that other non-circular shapes, such as triangles, ovals, rectangles, and the like, may be used. In some embodiments, the non-circular opening 106 of one or more of the plates 104 may further define a notch 108. Notch 108 may be used to provide clearance for a locking pin that locks the drive shaft within the paper core 100.

Figure 2:
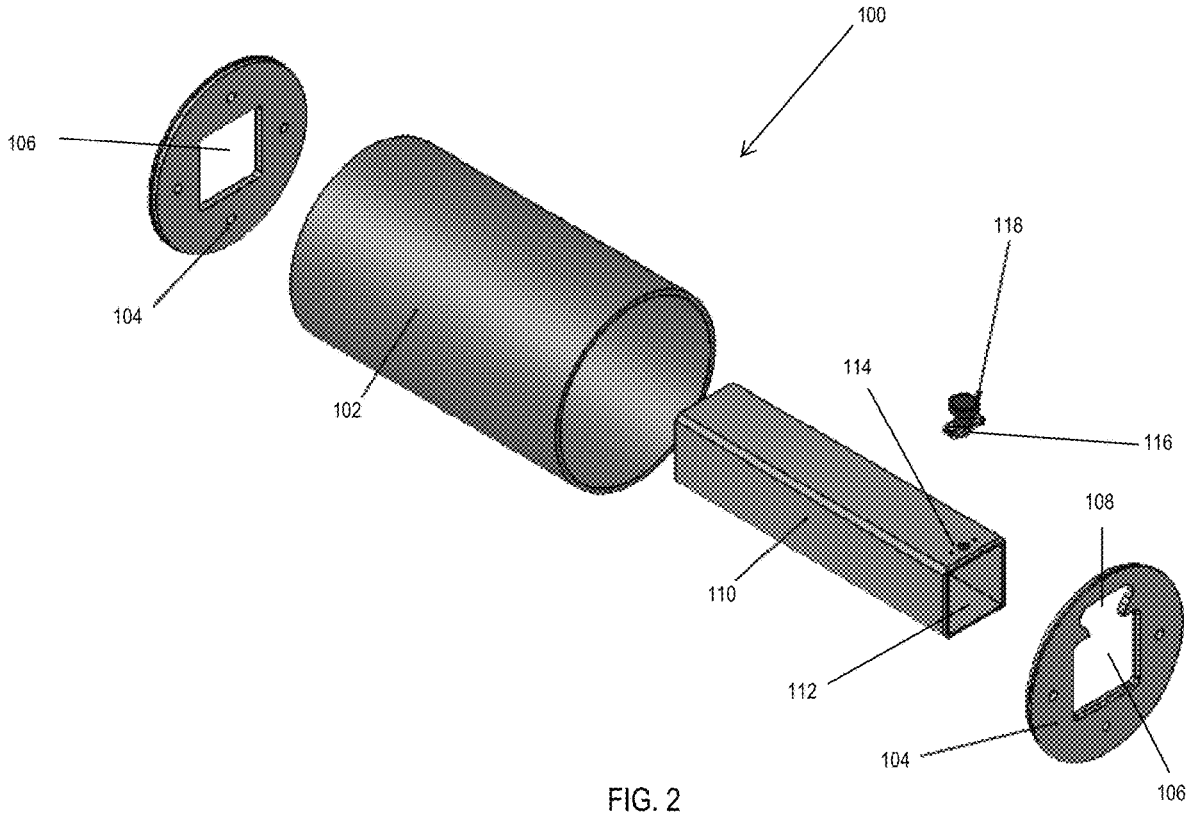
FIG. 2 is an exploded view of the metallic paper core of FIG. 1.

FIG. 2 shows an exploded view of paper core 100. Here, two plates 104 are included, with one plate 104 positioned at each end of the cylindrical body 102. Plates 104 may be formed integral with the cylindrical body 102 or may be manufactured separately and later attached to the cylindrical body 102. For example, the plates 104 may be welded and/or otherwise secured with the ends of cylindrical body 102. In some embodiments, the entire outer periphery of the plates 104 may be secured with the ends of the cylindrical body 102, while in other embodiments only a portion of the outer periphery of the plates 104 is secured with the ends of the cylindrical body 102. In other embodiments, one or more plates 104 may be disposed within an interior of the cylindrical body 102 and spaced a distance apart from the ends of the cylindrical body 102. While shown with one of the plate 104 having a notch 108 formed in the central opening 106, it will be appreciated that none or all of the plates 104 may include a notch 108. For example, both plates 104 may include a notch 108 to accommodate a pin for securing a drive shaft within the cylindrical body 102 near each end of the cylindrical body 102 and/or to allow the paper core 100 to be mounted in either direction on a drive shaft having a single pin. While shown with circular plates 104, it will be appreciated that plates having other shapes may be used as long as the plates are capable of coupling with the cylindrical body 102. As just one example, a cross-shaped plate may be used that defines a central opening for a drive shaft. The cross-shaped plate may be configured to be coupled with the cylindrical body 102 at each of the four arms of the cross shape, with a central opening formed at the junction of the arms.

In some embodiments, the paper core 100 may include a sleeve 110 that is configured to extend through a length of the cylindrical body 102. The sleeve 110 may be designed to have an outer shape and size that corresponds with the central opening 106 of each of the plates 104. This allows the sleeve 110 to fit within the central openings 106 without much clearance such that rotation of the sleeve 110 causes rotation of the rest of paper core 100 at the same rate. Sleeve 110 defines an additional non-circular central opening 112. Oftentimes, central openings 106 and 112 have the same general shape. For example, here both central openings 106 and 112 have square-shaped outer peripheries. This allows for a minimum amount of metal material to be used in the formation of paper core 100, as sleeve 110 may be a thin, hollow body that merely defines an outer shape of central opening 112. Such a design helps reduce material cost and weight of the finished paper core 100. However, in some embodiments, the central openings 106 and 112 may have different shapes. For example, a square-shaped central opening 106 may be defined by plate 104. A sleeve 110 may have a square-shaped outer periphery that corresponds with the size and shape of the central opening 106 such that the sleeve 110 may be inserted within the central opening 106 with sides of the sleeve 110 engaging the walls of central opening 106. The sleeve 110 may then define a central opening 112 having a different non-circular shape, such as a triangle that is configured to receive a triangular print drive shaft. The use of sleeve 110 may increase the contact area between a drive shaft and the paper core 100, thereby allowing the paper core 100 to be thinner while still supporting large forces associated with rolling exceptionally heavy rolls of paper. In some embodiments, sleeve 110 may be formed integral with the plates 104 and/or cylindrical body 102, while in other embodiments, the sleeve 110 may be formed separately and attached to the plates 104 by welding, fasteners, adhesives, and/or other securement mechanisms.

Figure 3:
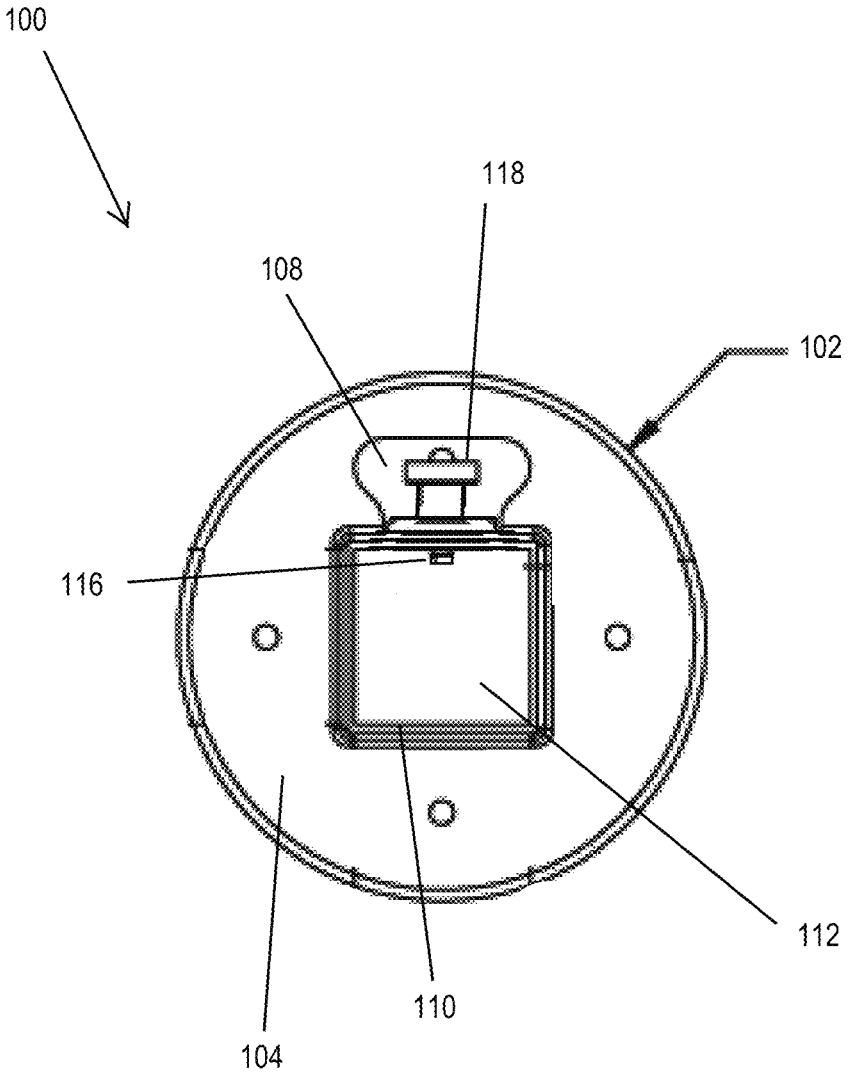
FIG. 3 is an end view of the metallic paper core of FIG. 1.

In some embodiments, the sleeve 110 may define one or more apertures 114 on one or more of the side walls of the sleeve 110. Aperture 114 may be configured to provide clearance for a pin 116 to extend into an interior of the sleeve 110. In some embodiments, pin 116 may be coupled with a flange that is mounted on an exterior surface of the sleeve 110. The pin may include a knob 118 that is spring biased to maintain the pin 116 in engagement with aperture 114 such that the pin 116 extends into the interior of the sleeve 110. Knob 118 may be pulled away from the exterior surface of sleeve 110 to pull the pin 116 out of the interior of the sleeve 110. Pin 116 allows a drive shaft positioned within the sleeve 110 to be secured within the sleeve 110 and ensures that the paper core 100 does not slide relative to the drive shaft. For example, when a drive shaft is inserted within the sleeve 110, the pin 116 may be pulled out of the interior of the sleeve 110 using knob 118 such that the drive shaft may be inserted into the sleeve 110 without bumping into a side of pin 116. Once the shaft is seated within the sleeve 110, pin 116 may be released and aligned with a receptacle or other mating surface on an outer surface of the drive shaft. Once aligned with the receptacle, the pin 116 may be biased to snap into the receptacle, thereby securing the drive shaft in a set position within the sleeve 110. While described using a pin 116 that is configured to be inserted within a receptacle of the drive shaft, it will be appreciated that other position locking mechanisms such as set screws may be utilized. Access to the knob 118 to engage and/or disengage pin 116 may be available via the notches 108, which may be sized to provide clearance around pin 116 and knob 118 as shown in FIG. 3. This clearance allows a user to grip the knob by hand or using a tool to manipulate a position of the pin 116.

Sleeve 110 may be attached to the plates 104 within the central openings 106. For example, an outer surface and/or edge of the sleeve 110 may be welded or otherwise secured to the plates 104. In some embodiments, the sleeve 110 may be approximately the same length as the cylindrical body 102 such that the ends of the sleeve 110 are aligned with the ends of the cylindrical body 102. In other embodiments, the sleeve 110 may be longer or shorter than the cylindrical body 102. For example, in some embodiments, the sleeve 110 may be shorter that the cylindrical body 102 and positioned entirely within an interior of the cylindrical body 102. In other embodiments, the sleeve 110 may be longer than the cylindrical body 102 such that a portion of sleeve 110 extends outside of the cylindrical body 102. In such embodiments, it may not be necessary for central openings 106 to include notches 108, as the pin 116 may be positioned beyond the outer edges of cylindrical body 102 and may be accessed easily from outside the cylindrical body 102.

Figure 4:
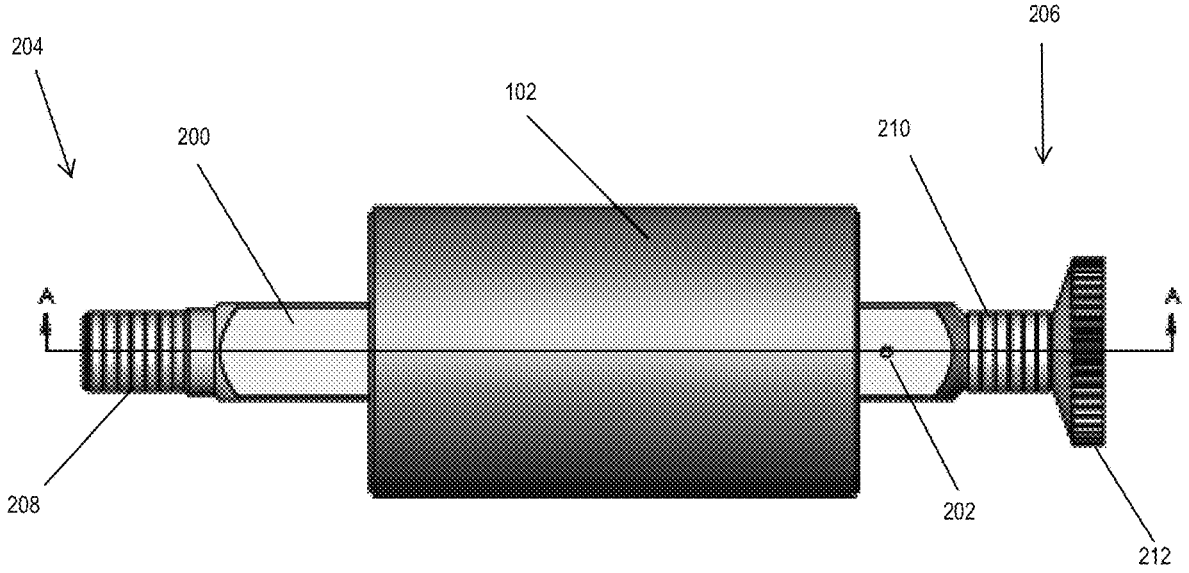
FIG. 4 is a side view of the metallic paper core of FIG. 1 secured with a drive shaft according to embodiments.
Figure 4A:
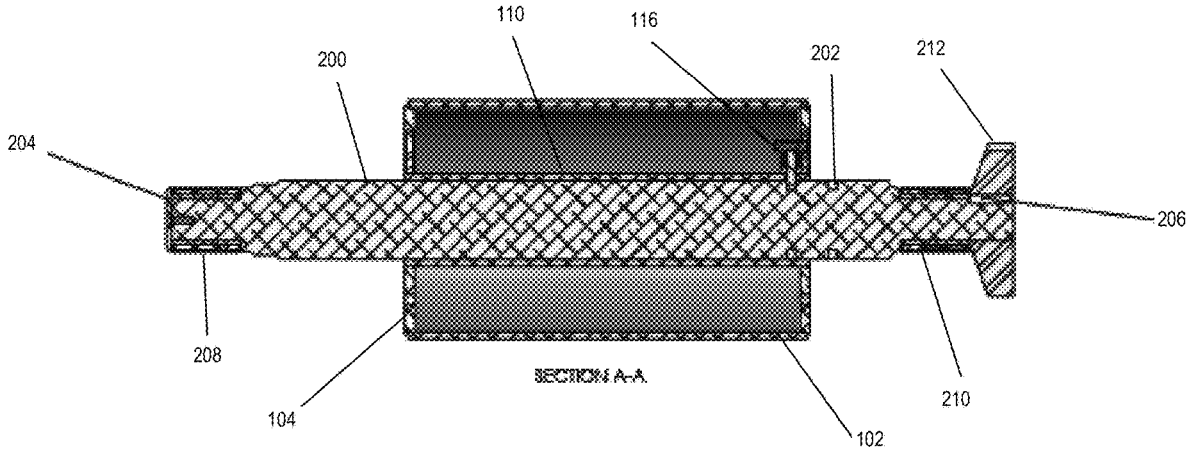
FIG. 4A is a side cross-sectional view of the metallic paper core and drive shaft of FIG. 4.

FIG. 4 depicts a side view of paper core 100 secured to a drive shaft 200. Here, drive shaft 200 is shown extending entirely through the paper core 100, with the shaft 200 being received within the sleeve 110. As best seen in FIG. 4A, an outer surface of a medial portion of drive shaft 200 is substantially flush with an inner wall of sleeve 110. For example, a medial portion of the drive shaft 200 may be sized and shaped to form a slip fit or similar fit connection with the sleeve 110 such that the drive shaft 200 cannot rotate independent of sleeve 110 and paper core 100, but may be easily inserted into and removed from the sleeve 110 when desired. In some embodiments, the medial portion of drive shaft 200 may define one or more receptacles 202. Receptacles 202 may be configured to receive an end of pin 116 such that the drive shaft 200 may be secured in place within the sleeve 110. It will be appreciated that any number of receptacles 202 may be provided on drive shaft 200. Receptacles 202 may be provided on one or more sides of the drive shaft 200. For example, receptacles 202 may be formed on all outer surfaces of the medial portion of drive shaft 200, enabling the drive shaft 200 to be inserted within sleeve 110 in any orientation while still allowing the pin 116 to engage at least one of the receptacles 202. Additionally, receptacles 202 may be provided at multiple locations along the length of drive shaft 200. This allows a single shaft 200 to be usable with various lengths of paper cores 100, as smaller paper cores 100 may be secured to drive shaft 200 at more inward positions of the drive shaft 200.

Drive shaft 200 may include a proximal end 204 and a distal end 206. In some embodiments, the distal end 206 may include one or more bearings 208. As just one example, distal end 206 may be covered by a bearing cap that may be secured by a mounting portion of a printer and/or insert apparatus. The bearing cap may help reduce friction between the drive shaft 200 and the mounting portion of the apparatus as the drive shaft 200 is rotated by the machinery. In some embodiments, the bearing cap may be secured to the distal end 206 using one or more fasteners. As just one example, one or more screws may be inserted through an end of the bearing cap and into the distal end 206 along or parallel to a longitudinal axis of the drive shaft 200. Proximal end 204 may include one or more bearings 210 and one or more gear keys 212. In some embodiments, bearings 210 may include a roller bearing, such as a needle roller bearing having an inner ring. Here, gear key 212 is positioned closer to proximal end 204 and may secure the bearing 210 onto the drive shaft 200. For example, gear key 212 may be attached to the proximal end 204 near its extreme edge and may have a larger diameter than the bearing 210 such that the gear key impedes the bearing 210 from moving along a length of drive shaft 200 and/or from falling off of drive shaft 200. In some embodiments, the medial portion of drive shaft 200 may have a greater diameter than the proximal end 204. The bearing 210 may be configured to fit on the smaller diameter of the proximal end 204, with the larger diameter of the medial portion 204 preventing the bearing 210 from sliding to a more central location along the drive shaft 200.

Gear key 212 may be configured to connect the drive shaft 200 to a rotating machine element of the printer or mail insert apparatus. The gear key 212 prevents relative rotation between the two parts and may enable torque transmission from the machinery to rotate the drive shaft 200 and paper core 100. For example, the gear key 212 may be configured to mesh with one or more gears of the machinery to transfer rotational force to the drive shaft 200. It will be appreciated that other torque transferring mechanisms may be used in place of, or in conjunction with, the gear key 212. Bearings 208 and 210 may be mounted on circular portions of drive shaft near the proximal and distal ends 204 and 206 that are separated by a non-circular medial portion. In some embodiments, the proximal end 204 and/or the distal end 206 may have a different thickness than the medial portion. It will be appreciated that bearing 208 and bearing 210 may include any number, size, and/or type of roller bearings. For example, in some embodiments multiple bearings will be provided on one or more of the proximal end 204 and the distal end 206. A same number, size, and/or type of bearings may be used at each location or different combinations of sizes, types, and numbers of bearings may be used at each site to meet the needs of a particular application.

Figure 5:
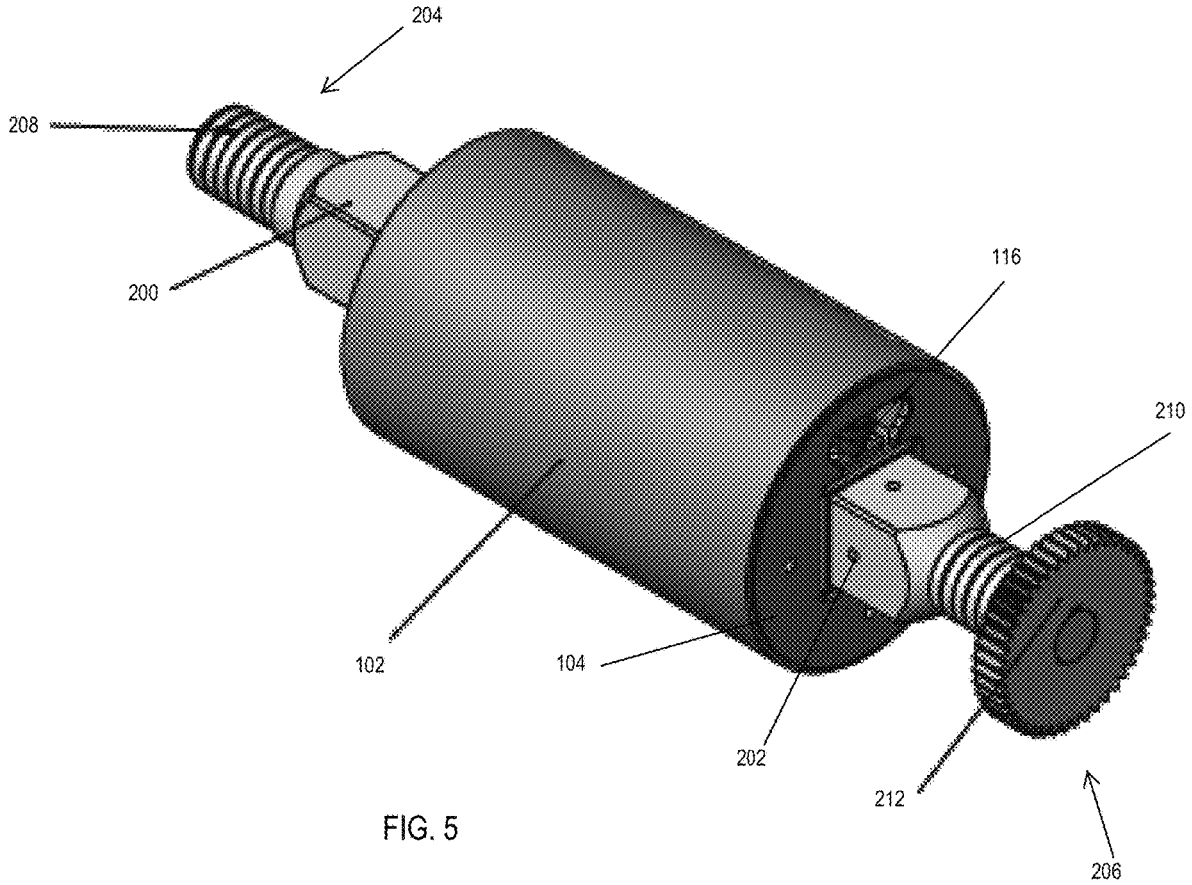
FIG. 5 depicts an isometric view of the metallic paper core and drive shaft of FIG. 4.

As seen in FIGS. 4A and 5, pin 116 may be positioned near the opening 106 and notch 108. For example, a portion of knob 118 may extend into and/or through the notch 108 such that a user may grab and manipulate the knob 118 to engage and/or disengage the pin 116. To provide such access, notch 108 may be larger than the pin 116 to allow sufficient clearance for the user to insert their fingers and/or a tool, such as pliers, to grasp the knob 118. Pin 116 or another position setting mechanism is necessary to prevent the paper core 100 from sliding on the drive shaft 200 during rotation of the drive shaft 200, as such sliding may cause the paper to roll unevenly on the paper core 100, leading to damaged paper and increased waste. As seen in FIG. 5, drive shaft 200 has a square-shaped outer periphery that is configured to be seated flush within the central opening 112 of sleeve 110. While drive shaft 200 is shown with a square-shaped profile, it will be appreciated that other non-circular drive shaft shapes may be used that prevent slippage of the drive shaft 200 within the paper core 100.

Figure 6:
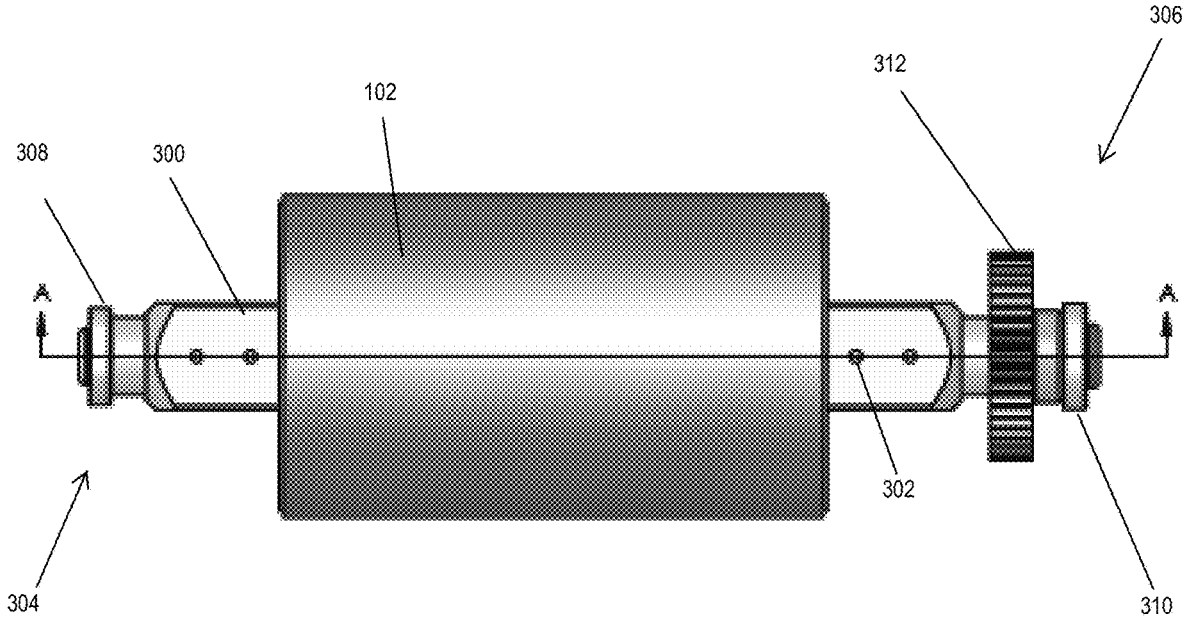
FIG. 6 is a side view of the metallic paper core of FIG. 1 secured with a drive shaft according to embodiments.
Figure 6A:
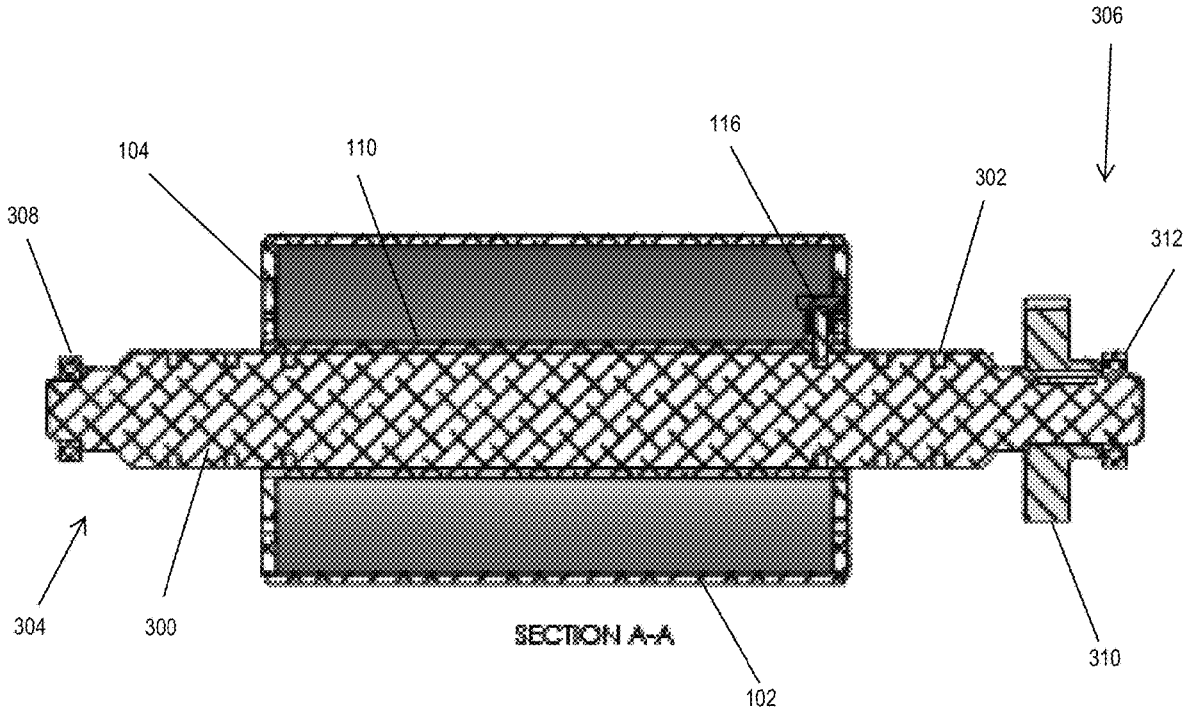
FIG. 6A is a side cross-sectional view of the metallic paper core and drive shaft of FIG. 4.

FIG. 6 depicts an alternative embodiment of a drive shaft 300 that is secured within paper core 100. Drive shaft 300 may have similar features as drive shaft 200. For example, drive shaft 300 is shown extending entirely through the paper core 100, with the shaft 300 being received within the sleeve 110. as best seen in FIG. 6A, an outer surface of a medial portion of drive shaft 300 is substantially flush with an inner wall of sleeve 110. For example, a medial portion of the drive shaft 300 may be sized and shaped to form a slip fit or similar fit connection with the sleeve 110 such that the drive shaft 300 cannot rotate independent of sleeve 110 and paper core 100 but may still be easily inserted into and removed from sleeve 110 when desired. In some embodiments, the medial portion of drive shaft 300 may define one or more receptacles 302. Receptacles 302 may be configured to receive a distal end of pin 116 such that the drive shaft 300 may be secured in place within the sleeve 110. It will be appreciated that any number of receptacles 302 may be provided on drive shaft 300. Receptacles 302 may be provided on multiple sides of the drive shaft 300. For example, receptacles 302 may be formed on all outer surfaces of the medial portion of drive shaft 300, enabling the drive shaft 300 to be inserted within sleeve 110 in any orientation while still allowing the pin 116 to engage at least one of the receptacles 302. Additionally, receptacles 302 may be provided at multiple locations along the length of drive shaft 300. This allows a single drive shaft 300 to be usable with various lengths of paper cores 100, as smaller paper cores 100 may be secured to drive shaft 300 at more inward positions of the drive shaft 300.

Drive shaft 300 may include a proximal end 304 and a distal end 306. In some embodiments, the distal end 306 may include one or more bearings 308. As just one example, distal end 306 may be covered by a bearing 308 that, when mounted in a printer or other apparatus, may help reduce friction as the drive shaft 300 is rotated by the machinery. In some embodiments, the bearing 308 may be secured on the drive shaft 300 using on or more fasteners. In other embodiments, the bearing 308 may be press fit or otherwise secured on the distal end 306 of the drive shaft 300 without the use of a fastener. Proximal end 306 may include one or more bearings 310 and one or more gear keys 312. Here, gear key 312 is positioned interiorly of the bearing 310 relative to the proximal end 304 of the drive shaft 300. For example, bearing 310 may be attached to the proximal end 304 near its extreme edge and impede the gear key 312 from moving along a length of drive shaft 300 and/or from falling off of drive shaft 300. Bearing 310 may be secured to the drive shaft 300 using one or more fasteners. For example, bearing 310 may be a bearing cap that includes one or more fasteners that are inserted within an end of the bearing cap and extend into an end of the drive shaft 300. In other embodiments, the bearing 310 may be a conventional roller bearing that is press fit and/or otherwise secured to a circumferential portion of the drive shaft 300. It will be appreciated that bearing 208 and bearing 210 may include any number, size, and/or type of roller bearings. For example, in some embodiments multiple bearings will be provided on one or more of the proximal end 204 and the distal end 206. A same number, size, and/or type of bearings may be used at each location or different combinations of sizes, types, and numbers of bearings may be used at each site to meet the needs of a particular application.

In some embodiments, the medial portion of drive shaft 300 may have a greater diameter than the proximal end 304. The gear key 312 may be configured to fit on the smaller diameter of the proximal end 304, with the larger diameter of the medial portion 304 preventing the gear key 312 from sliding to aa more central location along the drive shaft 300. In some embodiments, one or more fasteners, pins, set screws, and/or other securement mechanisms may be used to couple gear key 312 to the drive shaft 300 and to prevent the gear key 312 from sliding along the length of the drive shaft 300. Gear key 312 may be configured to connect the drive shaft 300 to a rotating machine element of the printer or mail insert apparatus. The gear key 312 prevents relative rotation between the two parts and may enable torque transmission from the machinery to rotate the drive shaft 300 and paper core 100. For example, the gear key 312 may be configured to mesh with one or more gears of the machinery to transfer rotational force to the drive shaft 300. It will be appreciated that other torque transferring mechanisms may be used in place of, or in conjunction with, the gear key 312. Bearings 308 and 310 may be mounted on circular portions of drive shaft near the proximal and distal ends 304 and 306 that are separated by a non-circular medial portion. In some embodiments, the proximal end 304 and/or the distal end 306 may have a different thickness than the email portion.

Figure 7:
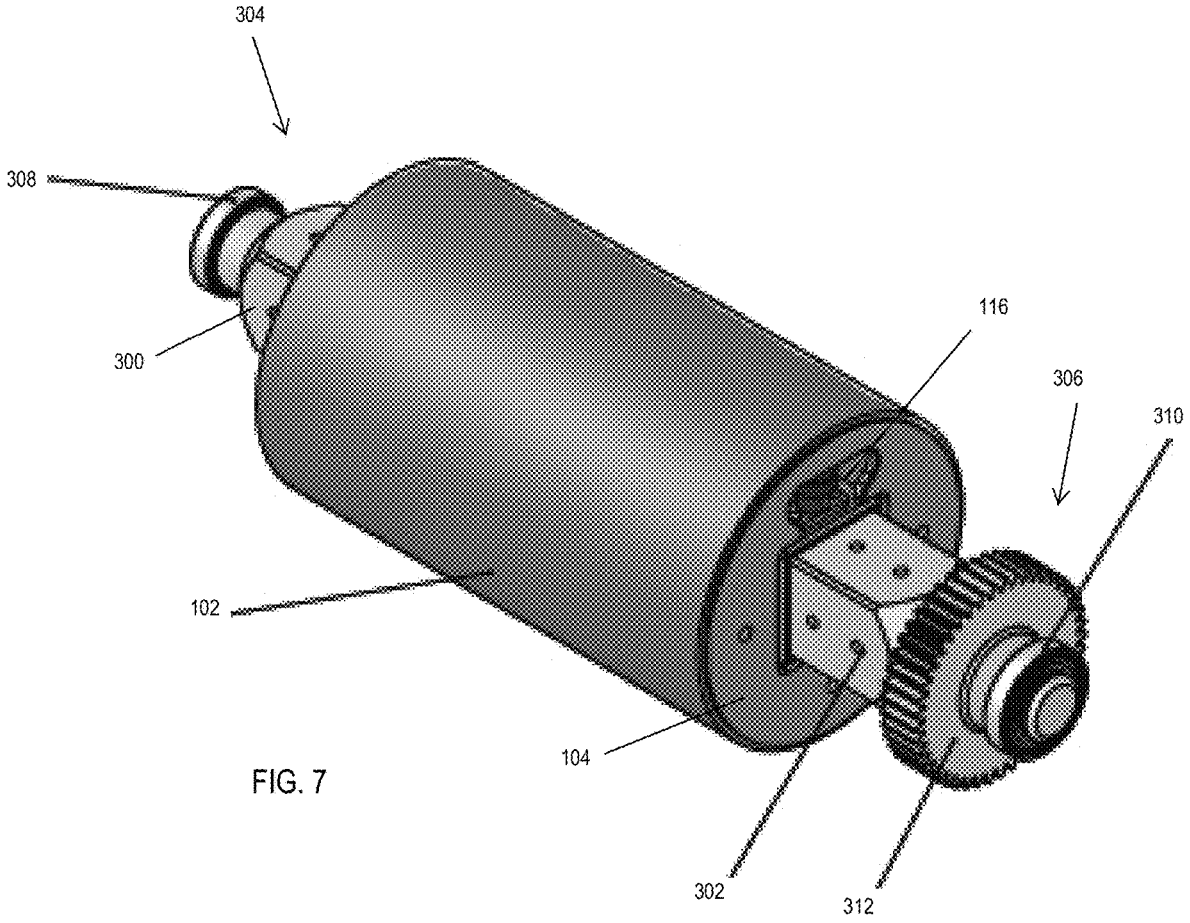
FIG. 7 depicts an isometric view of the metallic paper core and drive shaft of FIG. 4.

As seen in FIGS. 6A and 7, pin 116 may be positioned near the opening 106 and notch 108. For example, a portion of knob 118 may extend into and/or through the notch 108 such that a user may grab and manipulate the knob 118 to engage and/or disengage the pin 116. To provide such access, notch 108 may be larger than the pin 116 to allow sufficient clearance for the user to insert their fingers and/or a tool, such as pliers, to grasp the knob 118. Pin 116 or another position setting mechanism is necessary to prevent the paper core 100 from sliding on the drive shaft 300 during rotation of the drive shaft 300, as such sliding may cause the paper to roll unevenly on the paper core 100, leading to damaged paper and increased waste. As seen in FIG. 7, drive shaft 300 has a square-shaped outer periphery that is configured to be seated flush within the central opening 112 of sleeve 110. While drive shaft 300 is shown with a square-shaped profile, it will be appreciated that other non-circular drive shaft shapes may be used that prevent slippage of the drive shaft 300 within the paper core 100.

In some embodiments, sleeve 110 may be omitted, with the shaft 200 or 300 being configured to be received within the center openings 106 of the one or more plates 104. The shaft 200 or 300 may then be sized and shaped to fit tightly within the center openings 106 such that the shaft 200 or 300 cannot wiggle or rotate independent of plates 104. To help aid in handling the large torques applied by the machinery without the use of sleeve 110 to spread the forces out over a larger area, a larger number of plates 104 may be provided along a length of the cylindrical body 102. In some embodiments, the plates 104 may be manufactured to be thicker, which enables the mounting surface between the cylindrical body 102 and the plates 104 to be increased. Additionally, the thicker profile of the plates 104 provides a larger contact area to spread out forces applied by the shaft 200 or 300. Since there is no sleeve 110 or pin 116 to secure the paper core 100 at a set position on shaft 200 or 300, the shaft 200 or 300 may include a collar, set screw, and/or other positioning mechanism on both a proximal end and a distal end of the shaft to ensure that the paper core 100 cannot slide relative to the shaft. For example, a collar may be positioned on the shaft on either side of the paper core 100 proximate a plate 104. Once positioned, the collar may be tightened against the shaft, such as by using a set screw, a compression mechanism of the collar, or other mechanism, to set a position of the paper core relative to the shaft. A similar procedure may be done on an opposite side of the paper core 100 to limit and/or eliminate any sliding of the paper core 100 on the shaft during rotation of the shaft.

Figure 8:
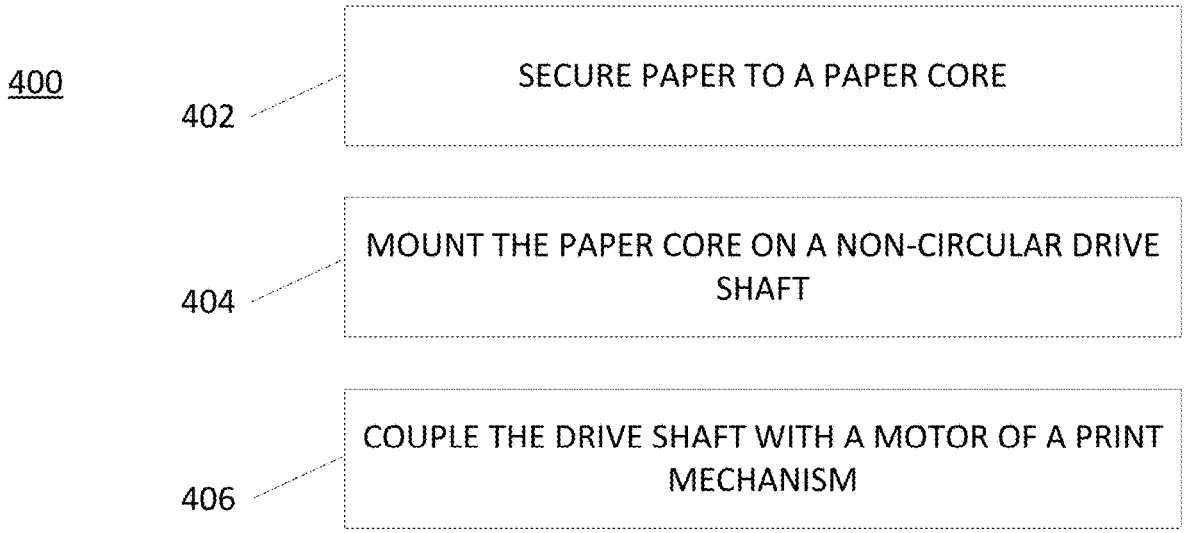
FIG. 8 is a flowchart depicting a process for printing mailing inserts according to embodiments.

FIG. 8 is a flowchart depicting a process 400 for printing mailing inserts. Process 400 may be performed using paper core 100 and either of shafts 200 or 300. Process 400 may begin at block 402 by securing one end of a roll of paper to a reusable paper core. For example, one end of the paper may be taped or otherwise adhered to an outer surface of the reusable paper core. By taping the paper to the reusable paper core, a user is assured that the paper may be easily removed from the reusable paper core when the majority of the paper has been utilized and removed from the roll of paper. The paper core may be formed from a metal material.

Typically, a metal having a high strength to weight ratio and having a low cost is used, such as aluminum. The metallic surface provides an improved surface for removing tape without damaging the outer surface when compared to conventional cardboard cores that may peel or tear as tape is removed. The reusable paper core may include a cylindrical body having a circular outer periphery surrounding an open interior. The cylindrical body may be configured to receive a roll of paper and act as a spool about which the paper may be wrapped. The reusable paper core may include at least one plate that spans at least a portion of the open interior such that the at least one plate connects at least two portions of the outer periphery. Oftentimes, the plate or plates will contact an entire circumference of the cylindrical body; however, less contact is possible in some designs. The at least one plate defines a non-circular central opening that may be configured to receive a sleeve and/or a drive shaft. Oftentimes, the non-circular shaft may have a square-shaped cross-section, however other non-circular shapes may be used that prevent the drive shaft and/or sleeve from slipping and ensure that the paper core rotates in synch with the drive shaft.

In some embodiments, a sleeve may be provided within the non-circular central opening. The sleeve may extend across a length of the cylindrical body and have an outer shape and size that corresponds with a shape of the non-circular central opening of the plate(s). This allows the sleeve to fit snuggly and be securely mounted (or formed integral) within the central openings of the plates. The sleeve may itself define its own non-circular central opening that is configured to receive the drive shaft. While the central opening of the sleeve may be the same shape as the central opening of the plate(s), the two central openings may have different shapes.

At block 404, the reusable paper core may be mounted on a non-circular drive shaft by inserting the drive shaft within the non-circular central opening of the at least one plate and/or within the non-circular central opening of the sleeve. The drive shaft may be sized and shaped to be snuggly inserted within the central opening of the sleeve and/or the plates such that rotation of the drive shaft causes the paper core to rotate at the same rate due to contact forces applied by the exterior surface of the drive shaft to the plates and/or sleeve of the paper core. In some embodiments, the reusable paper core includes a pin that is configured to extend into an interior of the sleeve. For example, a spring biased pin may be mounted on an outside surface of the sleeve with the pin being biased to extend into an interior of the sleeve. The pin may be pulled out of the interior of the sleeve while the drive shaft is inserted and then allowed to spring back into the interior of the sleeve when the drive shaft is positioned within the sleeve. The pin may be configured to seat within a receptacle formed within the body of the drive shaft to lock the drive shaft at a particular position relative to the sleeve of the paper core. For example, mounting the reusable paper core on the non-circular drive shaft comprises engaging distal end of the pin with a mating surface of the drive shaft to secure the drive shaft within the sleeve. In other embodiments, such as those without a sleeve, set screws, collars, and/or other positioning mechanisms may be positioned and tightened against the drive shaft at positions proximate to the one or more plates to prevent the paper core from sliding along the drive shaft. In embodiments having a sleeve with a pin to lock a position of the paper core on the drive shaft, the non-circular central opening of the one or more plates may further defines a notch that is configured to allow access to the pin from an exterior of the reusable paper core such that the pin may be manipulated between an engaged position and a disengaged position. For example, the notch may be sized to provide sufficient clearance for a user's fingers or a tool to grasp a portion of the pin.

Once the paper core is secured on the drive shaft, the drive shaft may then be coupled to a motor of a printer or mail insert mechanism such that the mechanism can rotate the paper core by rotating the drive shaft at block 406. This may be done by engaging a gear key of the drive shaft with a gear mechanism coupled with a transmission and/or motor of the mechanism. This allows the mechanism to deliver torque to the drive shaft via the gear key. In some embodiments, one or both ends of the drive shaft may include bearings that may be held within a mounting site of the printer or insert mechanism. These bearings minimize friction between the mounting sites and the drive shaft during rotation of the drive shaft.

The printer mechanism may print statements or other information on the paper and rotate the drive shaft and paper core to wind the printed paper onto the paper core. Once printed and rolled up, the paper roll may need to be transported to an insert apparatus, such as by using a specialized carts may be used to move the paper rolls. Once transported to the insert apparatus, the paper roll, paper core, and drive shaft may be mounted. The insert apparatus may then rotate the drive shaft to unroll the paper for cutting and inserting individual statements, inserts, and the like into mailings. In many embodiments, the printer and insert mechanisms may use different drive shafts. In such embodiments, a drive shaft that is compatible with each particular machine may be inserted and secured within the paper core prior to mounting the paper core within the machinery. Because the paper cores described herein eliminate the use of airshafts, additional time is saved as the new drive shafts may be quickly inserted and locked within the paper cores using simple mechanical coupling mechanisms, thus eliminating the time needed to inflate and deflate two sets of air bladders for two different airshafts as is necessary in conventional applications.

It should be noted that the systems and devices discussed above are intended merely to be examples. It must be stressed that various embodiments may omit, substitute, or add various procedures or components as appropriate. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

Specific details are given in the description to provide a thorough understanding of the embodiments. However, it will be understood by one of ordinary skill in the art that the embodiments may be practiced without these specific details. For example, well-known structures and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

Having described several embodiments, it will be recognized by those of skill in the art that various modifications, alternative constructions, and equivalents may be used without departing from the spirit of the invention. For example, the above elements may merely be a component of a larger system, wherein other rules may take precedence over or otherwise modify the application of the invention. Also, a number of steps may be undertaken before, during, or after the above elements are considered. Accordingly, the above description should not be taken as limiting the scope of the invention.

Also, the words "comprise", "comprising", "contains", "containing", "include", "including", and "includes", when used in this specification and in the following claims, are intended to specify the presence of stated features, integers, components, or steps, but they do not preclude the presence or addition of one or more other features, integers, components, steps, acts, or groups.

What is claimed is:

1. A driveshaft for a reusable paper core, comprising:

a shaft body having a proximal end, a distal end, and a medial portion extending between the proximal end and the distal end, wherein an outer periphery of the medial portion has a non-circular cross-sectional shape;

one or more receptacles provided in an outer surface of the medial portion of the shaft body;

a first bearing coupled with the distal end;

a second bearing coupled with the proximal end;

one or more gear keys coupled with the proximal end, the one or more gear keys being configured to transfer force from a rotating machine element to the driveshaft; and wherein:

the medial portion of the shaft body is thicker than the proximal end and the distal end of the shaft body.

2. The driveshaft for a reusable paper core of claim 1, wherein:

the one or more gear keys are disposed between the second bearing and the medial portion of the shaft body.

3. The driveshaft for a reusable paper core of claim 1, wherein:

the second bearing is disposed between the one or more gear keys and the medial portion of the shaft body; and the one or more gear keys secure the second bearing onto the proximal end.

4. The driveshaft for a reusable paper core of claim 1, further comprising:

a bearing cap coupled with the distal end beyond an edge of the first bearing.

5. The driveshaft for a reusable paper core of claim 1, wherein:

each side of the outer surface of the medial portion of the shaft body comprises at least one of the one or more receptacles.

6. The driveshaft for a reusable paper core of claim 1, wherein:

the one or more receptacles comprise a plurality of receptacles arranged in a linear pattern along a length of the outer surface of the medial portion.

7. The driveshaft for a reusable paper core of claim 1, wherein:

each of the one or more receptacles is configured to receive a pin of a paper core mounted on the driveshaft.

8. The driveshaft for a reusable paper core of claim 1, wherein:

the reusable paper core is mounted on the driveshaft; and each paper core-engaging face of the outer surface of the medial portion of the shaft body comprises at least one of the one or more receptacles.

9. A reusable paper core system, comprising:

a driveshaft comprising:

a shaft body having a proximal end, a distal end, and a medial portion extending between the proximal end and the distal end, wherein an outer periphery of the medial portion has a non-circular cross-sectional shape;

a first bearing coupled with the distal end;

a second bearing coupled with the proximal end; and one or more gear keys coupled with the proximal end, the one or more gear keys being configured to transfer force from a rotating machine element to the driveshaft; and a paper core comprising a cylindrical outer surface that is configured to receive a roll of paper, wherein:

the paper core includes a non-circular central opening that receives the medial portion of the shaft body;

a shape of the non-circular central opening matching the non-circular cross-sectional shape of the medial portion of the shaft body; and wherein:

the medial portion of the shaft body is thicker than the proximal end and the distal end of the shaft body.

10. The reusable paper core system of claim 9, wherein:

an outer surface of the medial portion is substantially flush with an inner surface of the paper core that includes the non-circular central opening.

11. The reusable paper core system of claim 9, wherein:

a thickness of the distal end of the shaft body is less than a size of the non-circular central opening of the paper core, thereby enabling the paper core to be removed from and inserted onto the medial portion of the shaft body.

12. The reusable paper core system of claim 9, wherein:

the driveshaft further comprises one or more receptacles provided in an outer surface of the medial portion of the shaft body; and the paper core further comprises a pin that is configured to extend through at least a portion of the paper core and into a respective one of the one or more receptacles in the outer surface of the medial portion of the shaft body to secure the paper core onto the driveshaft.

13. The reusable paper core system of claim 12, wherein:

each side of the outer surface of the medial portion of the shaft body comprises at least one of the one or more receptacles.

14. The reusable paper core system of claim 12, wherein:

the one or more receptacles comprise a plurality of receptacles arranged in a linear pattern along a length of the outer surface of the medial portion.

15. The reusable paper core system of claim 9, wherein:

the non-circular central opening and the non-circular cross-sectional shape of the medial portion of the shaft body are square-shaped.

16. A method for mounting a paper roll on a drive shaft of a printing mechanism, comprising:

securing one end of a roll of paper to a reusable paper core, the reusable paper core comprising a cylindrical outer surface that is configured to receive the roll of paper, wherein the paper core includes a non-circular central opening;

mounting the reusable paper core on a non-circular driveshaft by inserting a distal end of a shaft body of the driveshaft within the non-circular central opening of the reusable paper core and positioning the reusable paper core about a medial portion of the shaft body, wherein:

the shaft body further comprises a proximal end positioned on an opposite side of the medial portion as the distal end;

an outer periphery of the medial portion has a non-circular cross-sectional shape;

the distal end comprises a first bearing; and the proximal end comprises at least one gear key;

engaging the at least one gear key with a motor of a printing mechanism and the first bearing with a mounting site of the printing mechanism; and wherein:

the medial portion of the shaft body is thicker than the proximal end and the distal end of the shaft body.

17. The method for mounting a paper roll on a drive shaft of a printing mechanism of claim 16, wherein:

a shape of the non-circular central opening matches the non-circular cross-sectional shape of the medial portion of the shaft body.

18. The method for mounting a paper roll on a drive shaft of a printing mechanism of claim 16, wherein:

the proximal end further comprises a second bearing to minimize friction at a mounting site of the at least one gear key when the driveshaft is rotated.

19. The method for mounting a paper roll on a drive shaft of a printing mechanism of claim 16, wherein:

an outer surface of the medial portion of the shaft body includes one or more receptacles;

the paper core further comprises a pin that is configured to extend through at least a portion of the paper core and into the non-circular central opening; and mounting the reusable paper core on the non-circular driveshaft comprises engaging a distal end of the pin with one of the one or more receptacles to secure the driveshaft within the non-circular central opening.

20. The method for mounting a paper roll on a drive shaft of a printing mechanism of claim 16, wherein:

the at least one gear key is engaged with the motor via a transmission of the printing mechanism.

21. The method for mounting a paper roll on a drive shaft of a printing mechanism of claim 16, further comprising:

applying rotational force to the at least one gear key using a motor of the printing mechanism to rotate the drive-shaft and the reusable paper core.

* * * * *